United States Patent [19]

Nishijima

[11] Patent Number: 4,471,527

[45] Date of Patent: Sep. 18, 1984

[54] METHOD AND APPARATUS FOR THE PRODUCTION OF STRANDED CABLE

[75] Inventor: Tamotu Nishijima, Shizuoka, Japan

[73] Assignee: Yazaki Corporation, Tokyo, Japan

[21] Appl. No.: 318,456

[22] Filed: Nov. 5, 1981

[51] Int. Cl.[3] ..... H01R 43/00; B21C 3/12

[52] U.S. Cl. ..... 29/872; 72/256; 72/261; 57/138; 29/33 F; 140/149

[58] Field of Search ..... 29/825, 872, 33 F; 72/60, 256, 261, 262, 263, 270; 57/9, 138, 311; 140/149; 264/103; 425/224, 515, 516

[56] References Cited

U.S. PATENT DOCUMENTS

| | | | |
|---|---|---|---|
| 3,299,686 | 1/1967 | Lemieux | 72/261 |
| 3,396,522 | 8/1968 | Biagini | 57/311 X |
| 3,641,755 | 2/1972 | Heinen et al. | 57/138 X |
| 3,765,216 | 10/1973 | Green | 72/263 X |
| 3,841,129 | 10/1974 | Nishihara et al. | 72/270 X |
| 3,872,703 | 3/1975 | Green . | |
| 3,948,079 | 4/1976 | Fuchs, Jr. | 72/261 X |
| 3,964,283 | 6/1976 | Fuchs, Jr. | 72/261 X |
| 4,055,979 | 11/1977 | Hunter et al. . | |
| 4,163,377 | 8/1979 | Moreau . | |
| 4,212,151 | 7/1980 | Schauffelle et al. | 57/138 X |
| 4,217,852 | 8/1980 | Nagai et al. . | |
| 4,242,368 | 12/1980 | Nagai et al. . | |
| 4,356,846 | 11/1982 | Yamada et al. | 57/138 X |
| 4,362,485 | 12/1982 | Slater et al. . | |

FOREIGN PATENT DOCUMENTS

| | | | |
|---|---|---|---|
| 2925050 | 1/1981 | Fed. Rep. of Germany | 140/149 |

*Primary Examiner*—Carl E. Hall
*Assistant Examiner*—Carl J. Arles

[57] ABSTRACT

A method and apparatus for producing a stranded cable. The wire stretching step and annealing steps which have been performed independently prior to the twisting step in the field of stranded cable production are combined in the invented apparatus. The rotary element defines an annular space in cooperation with a shoe member such that the cross sectional area of the annular space decreases progressively. The roughened wire guided into the annular space via the shoe member is press molten and subjected to extrusion moulding to obtain a plurality of wires, which in turn are twisted together. Since the stretching and annealing are performed by a single apparatus, shop space conventionally required for device installation is reduced.

37 Claims, 22 Drawing Figures

METHOD AND APPARATUS FOR THE PRODUCTION OF STRANDED CABLE

BACKGROUND OF THE INVENTION

The present invention relates to a method of producing bare stranded wires, particularly stranded cables of mild steel, and an apparatus for the same.

Recognized stranded cables are generally classified into concentric lay cables, aggregate cables and composite cables which are commonly produced by successive steps of drawing, annealing and twisting. In the drawing step, a roughened wire of a relatively large diameter is drawn to prepare a wire of a smaller diameter. The twisting step on the other hand consists in twisting a plurality of such wires together around a core wire by a twister die; six wires may be twined around a single core wire to form a concentric cable, for example, which is the simplest of all the known types of stranded cables. The twisting step may be performed before or after the annealing step as the case may be.

Thus, the conventional stranded cable production line is made up of the following three independent steps:

(A) Stretching Step roughened wire→drawing machine→take-up machine (drum)

(B) Annealing Step (drum)→annealing machine or furnace→take-up machine (drum)

(C) Twisting Step (drum)→twisting machine→take-up machine (drum)

The production line, therefore, requires a large scale installation and a disproportionate area for the installation. Moreover, excessive power consumption is unavoidable because the take-up machines or drums in the successive steps (A)-(C) overlap each other.

There have been proposed various methods to extrusion mould wire material, among which the conforming process and the helical process are typical ones. The conforming process is a method, as described in U.S. Pat. No. 3,765,216, in which it includes the steps of supplying material continuously into a passageway formed between a rotary wheel and a stationary shoe, and continuously extrusion moulding wires out of orifices formed in the stationary shoe. In this method, however, extrusion moulded wires are not subjected to twisting operation. On the other hand, the helical process includes, according to U.S. Pat. No. 3,884,062, the steps of extruding billets in an annular form under static hydraulic pressure from between the primary die of helical configuration and a piercing mandrel, subjecting the extruded billets to machining operation by a rotary abutment in a similar manner to the operation on lathes, and extrusion moulding the product out of the die attached immediately in front of the abutment. This process is capable of extrusion moulding large diameter billets into wire-shaped products for a long operational time, thus providing less downtime than the conventional extrusion moulding. However, this method is considered to be suitable for production on a relatively small scale in view of its being an uncontinuous procedure and substantial inability to wind up the extrusion moulded products in helical form.

SUMMARY OF THE INVENTION

The present invention has been completed by combining the features of the helical process in which products are extruded in helical form hard to handle and the conforming process which is capable of extrusion moulding continuously. As a result, the extrusion moulding and the twisting operation can be done continuously.

It is an object of the present invention to provide a method and apparatus for the production of stranded cables in which drawing, annealing and twisting operations are performed in an uninterrupted flow so as to cut down the overall size of the apparatus, space requirement and power consumption.

It is another object of the present invention to provide a method to draw and anneal a plurality of wires in an uninterrupted flow by means of extrusion moulding.

It is a further object of the invention to provide a method to positively subject a plurality of extrusion moulded wires to twisting operation.

It is a still further object of the invention to provide a method in which a plurality of extrusion moulded wires are twisted in an uninterrupted flow.

It is a still further object of the invention to provide an apparatus which is capable of producing various kinds of stranded cables by interchanging one of the elements.

It is a still further object of the invention to produce various kinds of stranded cables by various combinations of a plurality of twisting apparatus.

In one aspect of the present invention, there is provided a method for the production of stranded cables in which dies are arranged annularly to rotate with a rotary element and feed out a plurality of wires therefrom by extrusion moulding, the plural wires being twisted together to form a stranded cable.

The plural wires from the dies may be twisted about another wire or stranded cable which is passed through an axis portion of the rotary element. Then the wires will form an aggregate stranded cable or a concentric lay cable as desired.

In another aspect of the present invention, there is provided an apparatus for the production of stranded cables which comprises a continuous extrusion mechanism having a rotary element formed with an annular recess or groove in its outer or inner periphery, the annular groove communicating with a pocket which is formed on the bottom or a side wall of the groove, and a stationary shoe member engaged in the annular groove and having a sectional area which decreases progressively at a predetermined rate, and a plurality of dies arranged annularly on the bottom or a side wall of the annular groove, said dies feeding a plurality of wires out therefrom in accordance with the rotation of the rotary element so that the wires are twisted together to form a stranded cable.

The rotary element may be formed with an axial through bore to feed another wire therethrough. This allows the production of an aggregate cable or a concentric cable as desired.

It is also possible to produce with ease a composite stranded cable by combining a plurality of units each including the above-mentioned apparatus.

In still further aspects, a method and apparatus of the present invention is characterized by continuously feeding out a wire, by an annular space, defined between an inner rotary element and an outer rotary element rotatable in a common direction, and a shoe member which is stationary, rotatable or rotatable and axially movable, cutting a plurality of wires from the wire by a rotary head which has a plurality of dies arranged annularly thereon, and twisting the plural wires together which are fed out from the rotary head.

The plural wires cut from the material can be twisted together with or about another wire which is supplied through an axis portion of the inner rotary element and/or the shoe member, thereby producing a composite twisted cable or a concentric cable.

BRIEF DESCRIPTION OF THE DRAWINGS

Drawings illustrate embodiments of the present invention, in which.

DETAILED DESCRIPTION OF EMBODIMENTS

Figure 1:
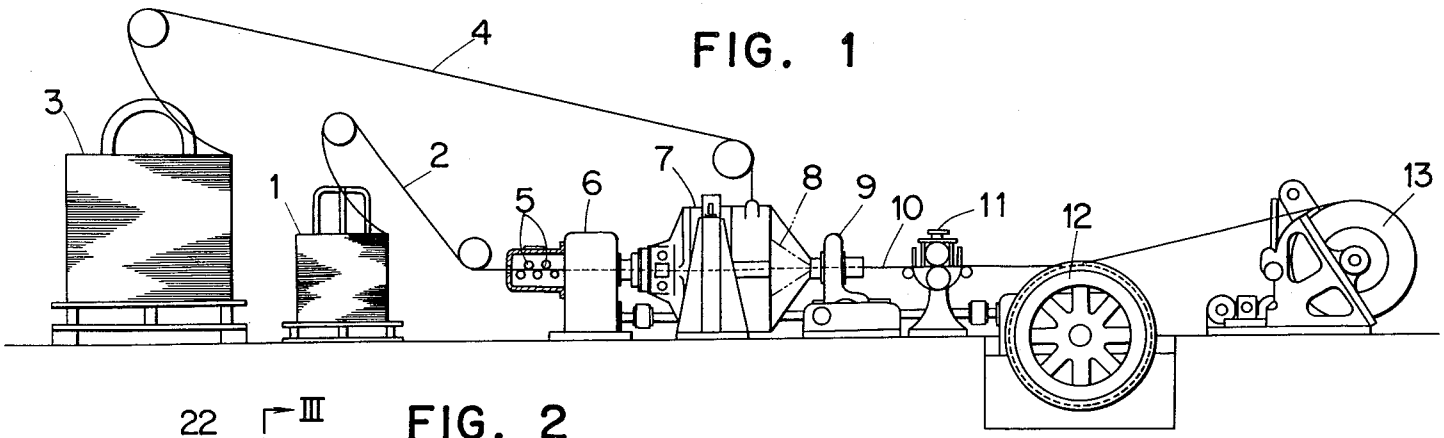
FIG. 1 is a view of an entire construction of a stranded cable production apparatus.

Referring to FIG. 1 of the drawings, there is shown an entire construction of a stranded cable production apparatus embodying the present invention. The apparatus includes a first carrier 1 having a small diameter wire 2 wound thereon and a second carrier 3 having a roughened large diameter wire 4 wound thereon. From the carrier 1, the wire 2 is supplied to a straightening device 6 which is equipped with a plurality of straightening rollers 5. The roughened wire 4 is payed out from the carrier 3 and passed to an extrusion moulding machine 7. This machine 7 moulds the roughened wire 4 into a plurality of wires 8 by extrusion. As will be described in detail hereinafter, the wires 8 are twisted together at a twister holder 9 about a center line which is defined by the wire 2, thereby forming a concentric lay cable 10. This cable 10 is passed through a counter 11 and then taken up on a take-up drum 13 via a capstan 12.

In the illustrated apparatus, the extrusion moulding machine 7 prepares a plurality of wires 8 all together while annealing them at the same time, and thus succeeds in establishing continuity between the conventional drawing and annealing operations.

Figure 3:
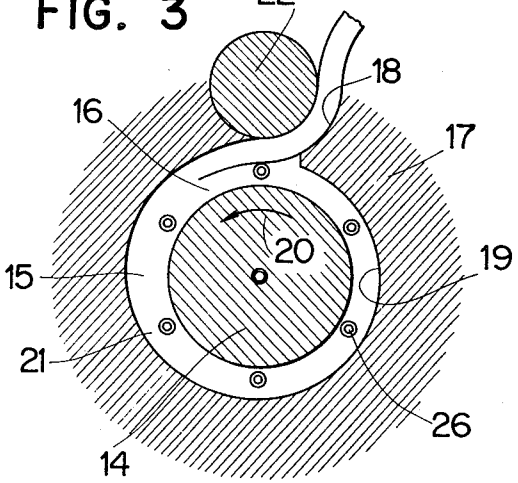
FIG. 3 is a section taken along line III—III of FIG. 2.
Figure 2:
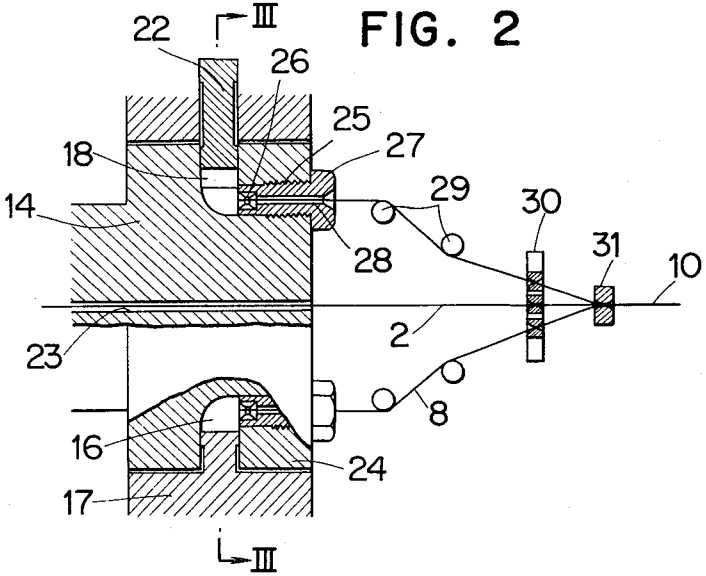
FIG. 2 is a fragmentary detailed view of an extrusion moulding machine included in the apparatus of FIG. 1.

FIGS. 2 and 3 are detailed fragmentary views of the extrusion moulding machine 7 and twister holder 9. The machine 7 comprises a rotary element 14 in the form of a disc which is in driven connection with a drive source. The disc 14 is formed with an annular recess or groove 15 on its outer periphery, and a pocket 16 at the bottom of the annular groove 15. A stationary annular shoe member 17 is engaged in the annular groove 15. A bore or wire supply passageway 18 extends throughout the shoe member 17 to communicate with the annular groove 15 in the disc 14 so as to guide a material (roughened wire) thereinto. The inner periphery 19 of the shoe member 17 protrudes into the annular groove 15 by a progressively increasing amount in the intended direction of rotation of the disc 14, which is indicated by an arrow 20 in FIG. 3. In other words, the inner periphery 19 of the shoe member 17 defines an annular passageway 21 whose sectional area decreases progressively in the direction of arrow 20, from a point where the wire supply passageway 18 meets the annular passageway 21 at a predetermined rate in cooperation with the bottom and side walls of the groove 15. A guide roller 22 is positioned in an upper portion of the shoe member 17 in such a manner to face the passageway 18.

The disc 14 is formed with an axial through bore 23 which is surrounded by a plurality of dies 26. In detail, threaded bores 25 extend throughout a front end portion 24 of the disc 14 into communication with the pocket 16 in the disc 14 and in parallel with the axial bore 23 of the disc 14. Die holders 27 are individually threaded into threaded bores 25 from the front end of the disc 14. Each die holder 27 is provided with an axial passageway 28 bored therethrough. Each die 26 is supported by the rearmost or innermost end of a die holder 27 to face the pocket 16 at one end thereof to provide communication between the annular passageway 21 and the axial passageway 28. In this structure, said dies are radially arranged in a plane perpendicular to an axis of the rotary element, each being disposed at an equal distance from the axis of the rotary element and spaced from the other by equal angular spacings.

The machine 7 further comprises a plurality of tension adjuster rollers 29 and a wire guide plate 30 in front of the disc 14. The twister holder 9 supports a twister die 31 rigidly therewith. Though not shown in the drawings, the path from the machine 7 to the twister holder 9 is furnished with suitable cooling means in order to prevent scales (copper oxide) from forming on the wires 8.

The arrangement shown in FIGS. 2 and 3 and described hereinabove will be operated as follows. The material (roughened wire 4) is fed by the guide roller 22 into the passageway 18 of the stationary shoe member 17 and further into the passageway 21 of the rotating disc 14. The wire 4 advances deeper into the passageway 21 in accordance with the rotation of the disc 14 until it completely fills the passageway 21, due to its friction with the outer periphery of the disc 14. During this movement, the wire 4 is progressively compressed because of the sectional area of the passageway 21 which progressively decreases due to the inherent configuration of the inner periphery 19 of the shoe member 17. As the resultant compressive stress in the wire 4 builds up to a predetermined value, the wire 4 is extruded by the dies 26 so that wires 8 having a desired diameter are produced continuously from the front end of the machine 7. In this way, the larger diameter wire 4 is moulded by the dies 26 into a plurality of smaller diameter wires 8 while generating a substantial amount of heat in response to the large compressive force imparted thereto. It will thus be seen that the drawing and annealing steps achieve continuity therebetween in contrast to the prior art system. These wires 8 have their tensions controlled to a predetermined constant level by the adjuster rollers 29 which are driven for revolution in unison with the disc 14. In the meantime, a core element (wire 2) is supplied through the axial bore 23 of the disc 14. The wires 8 are thus fed into the twister holder 9 together with the core wire 2 by way of the guide plate 30. Then, the twister die 31 on the holder 9 holds the wires 8 at one point and continuously twists them together around the core wire 2 in cooperation with the rotating disc 14 to prepare a concentric lay cable 10 of a single layer. The product 10 is successively wound up on the take-up drum 13 shown in FIG. 1 via the counter 11 and capstan 12.

Figure 4:
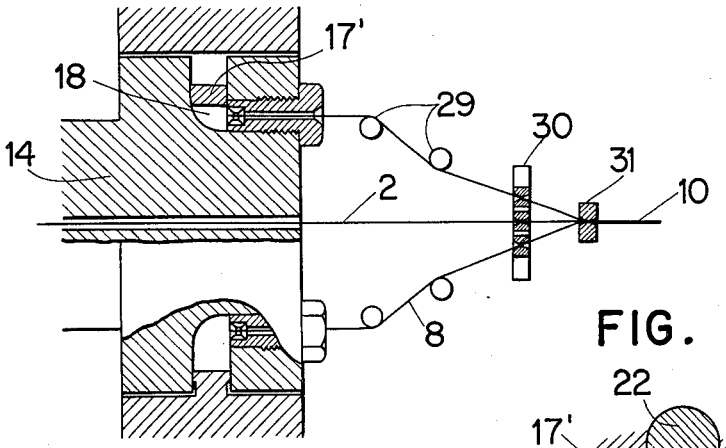
FIGS. 4–9 are fragmentary sectional views showing other possible forms of the extrusion moulding machine.
Figure 5:
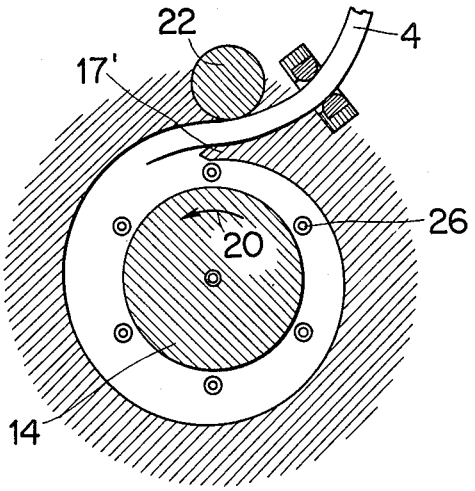

FIGS. 4 and 5 illustrate a stationary shoe member 17' which is a partly modified version of the stationary shoe member 17 of FIGS. 2 and 3. As shown, the modified shoe member 17' is longer than the shoe member 17. This will prove effective in minimizing the reverse flow of the material from the pocket to the passageway 18.

Figure 6:
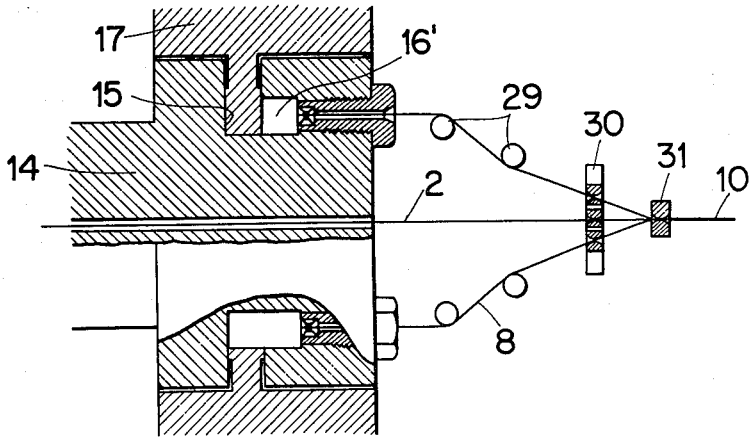

FIG. 6 shows an alternative position of the pocket in the disc 14. The pocket designated 16' is formed in a front side wall of the annular groove 15 instead of the bottom of the same. Such a position of the pocket permits a decrease in the diameter of the disc 14 and, therefore, decreases in the power to drive it for rotation.

Figure 7:
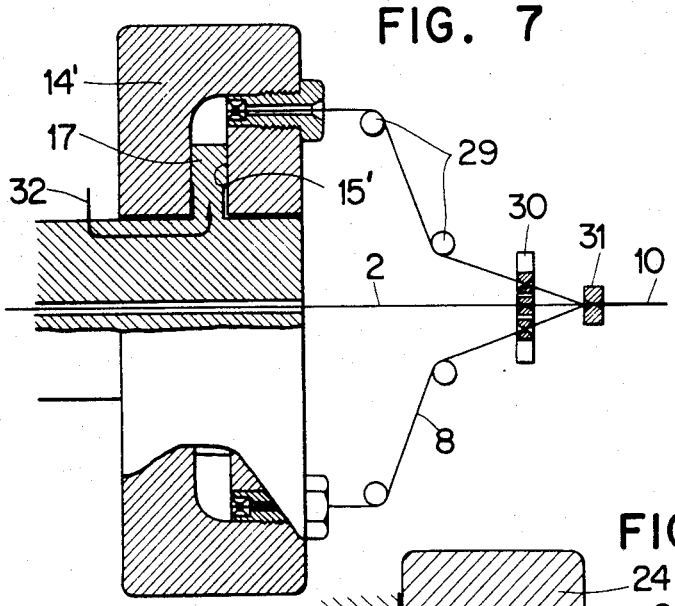

FIG. 7 illustrates another embodiment of the present invention in which a disc 14' comprises an annular member having a central bore extending therethroughout. An annular groove 15' is formed radially outwardly from its inner periphery. Thus, the stationary shoe member 17 is engaged in the groove 15' from inside the disc 14', not from the outside as in the foregoing embodiments. The wire 4 will be introduced into the groove 15' through a passage indicated by an arrow 32. An advantage obtainable with this construction is that the disc 14' can have a very thin configuration.

Figure 8:
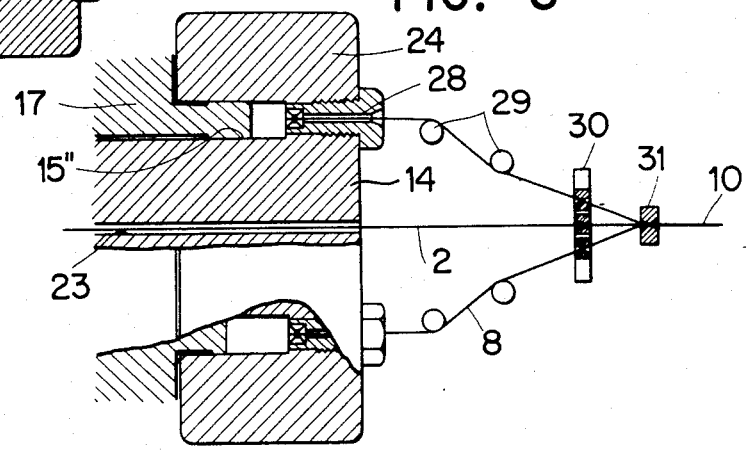
Figure 9:
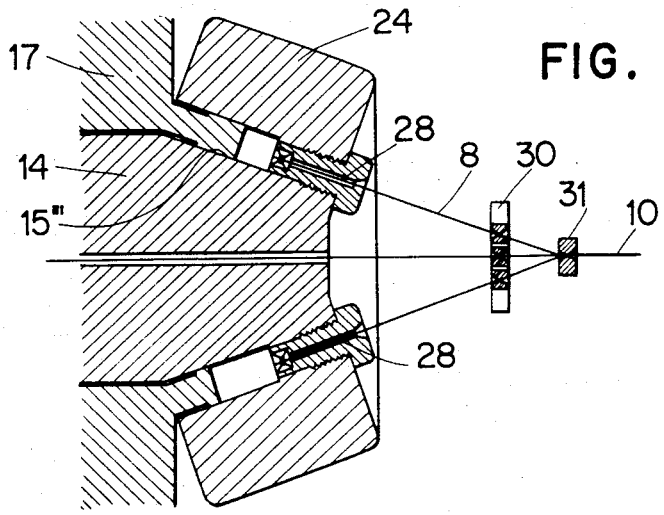

FIG. 8 shows another embodiment of the present invention in which an annular groove 15'' is formed axially in the front end portion 24 of the disc 14 in parallel with the axial bore 23. If desired, the annular groove 15'' may be inclined as viewed in FIG. 9 by forming the rotary element in a truncated conical shape. In detail, an annular groove 15''' in FIG. 9 is formed in the front end portion of the disc 14 in an axially forwardly, radially inwardly inclined position such that axial passageway 28 thereof intersects the axis of the disc 14. As will be seen from FIGS. 8 or 9, the outer periphery of the front end 24 of the disc 14 is not surrounded by the shoe member 17. This promotes the ease of cooling the front end 24 so that a minimum radial width is required of the annular groove 15'' or 15'''.

Figure 10:
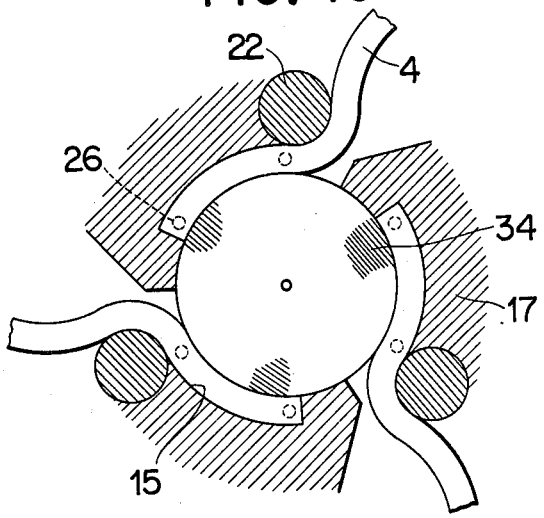
FIG. 10 is a diagram demonstrating the necessity of providing an annular groove with a pocket in accordance with the present invention.

FIG. 10 is a schematic view which illustrates the reason the pocket 16 must be provided to the annular groove 15 in the continuous extrusion by multiple dies 26. It will be understood from FIG. 10 that wires 4 can be extruded in hatched areas 34 of the disc 14 but not in the other areas. Stated another way, if the dies 26 were absent in the effective hatched areas, wires 8 would be produced regardless of the number of wires 4 (three in FIG. 10) supplied to the disc 14.

Figure 11:
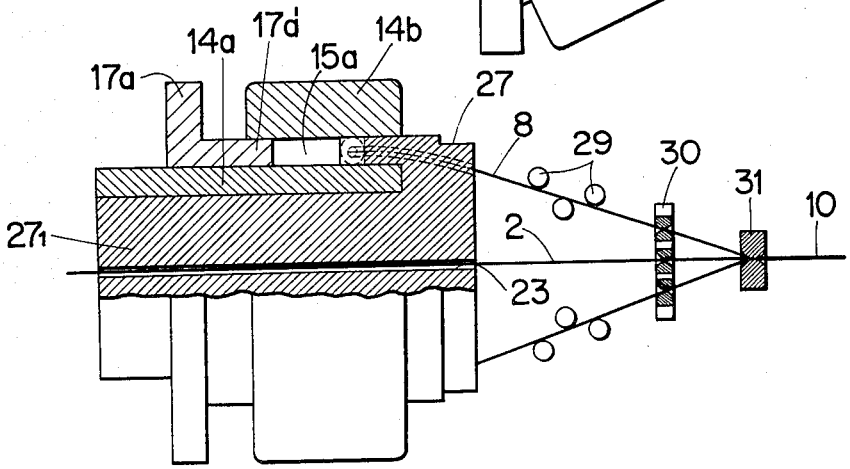
FIG. 11 is a fragmentary section of a cutting and extrusion moulding machine included in the system of FIG. 1.
Figure 12:
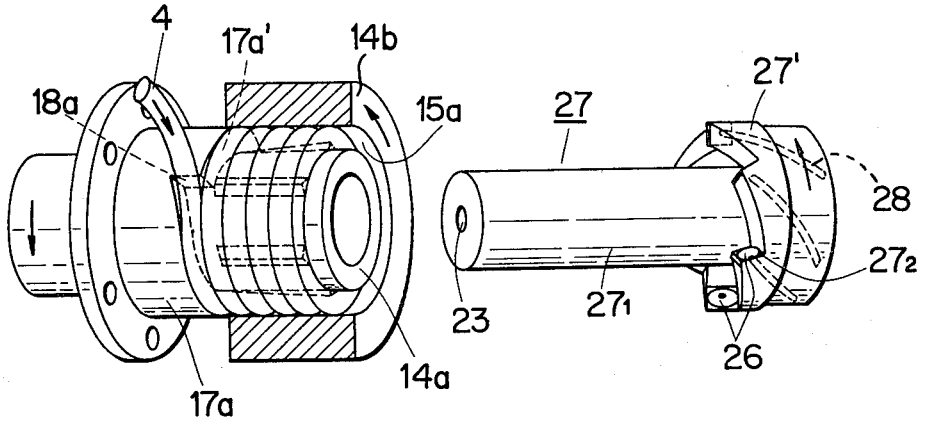
FIG. 12 is an exploded perspective view of the same machine.
Figure 13:
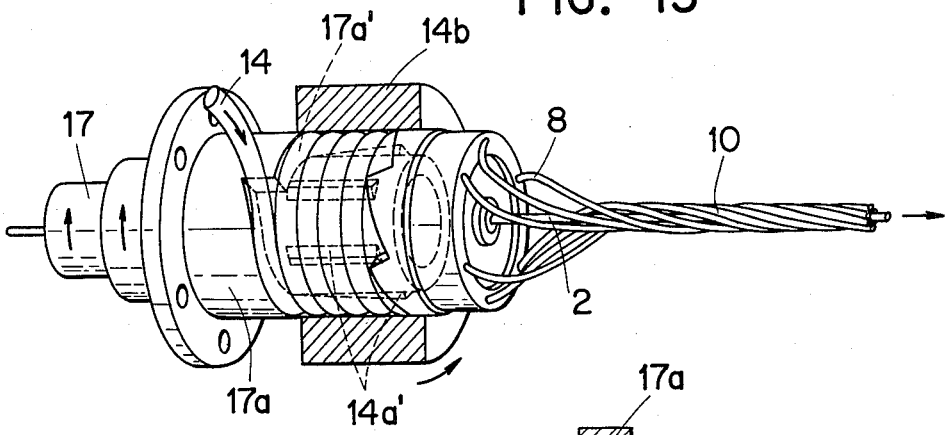
FIG. 13 is an assembled perspective view of the same machine.

FIGS. 11 to 13 are detailed fragmentary views of the cutting and extrusion moulding machine 7 and twister holder 9 in a still further modification. The machine 7 comprises an inner tubular member **14*a* driven for rotation by a motor (not shown) and an outer tubular member 14*b* coaxially surrounding the inner tubular member 14*a*. The inner tube 14*a* is provided with a plurality of axially extending lugs 14*a'* thereon for the purpose which will be described hereinafter. The inner tubular member 14*a* and outer tube 14*b* define an annular space 15*a* therebetween which is open at its axial opposite ends. An annular stationary shoe member 17*a* is located to face one open end of the annular space 15*a* between the tubes 14*a* and 14*b*. One end 17*a'* of the shoe member 17*a* which faces the space 15*a* is inclined or curved toward the space 15*a*. As viewed in FIG. 12, the shoe member 17*a* has its end 17*a'* partly notched to form a material supply passage 18*a*** which has one pitch of stagger between its inlet and outlet ends.

The machine 7 also comprises a rotary head 27 carrying a plurality of dies 26 therewith. Though the rotary head 27 can rotate in any direction depending on an intended direction of twist, it is assumed to rotate in a direction opposite to that of the inner tube **14*a* in the drawings. The rotary head 27 has a shank $27_1$ which is formed with an axial through bore 23 and coupled in the inner tube 14*a*. An annular die head 27' is provided to one end of the shank $27_1$ to be axially aligned with the annular space 15*a*. As shown in FIG. 12, the front end of the die head 27 is saw-toothed and formed with dies 26 on the leading faces $27_2$ of the individual teeth with respect to the direction of rotation. A passageway 28 extends from each die 26 to the flat rear end of the die head 27'. Each die 26** has a concave or inverted conical shape.

The machine 7 further comprises a plurality of tension adjuster rollers 29 and a wire guide plate 30 in front of the rotary head 27. The twister holder 9 in front of the machine 7 supports a twister die 31 thereon. Though not shown in the drawings, the path from the machine 7 to the twister holder 9 is furnished with suitable cooling means in order to prevent scales (metal oxides etc.) from forming on the wire 8.

The apparatus shown in FIGS. 11–13 and described hereinabove will be operated as follows. A material (roughened wire 4) is supplied into the apparatus from between the shoe member **17*a* and the outer tube 14*b* via the material supply passage 18*a*. The inner tube 14*a* and outer tube 14*b* in rotation feed the wire 4 toward the annular space 15*a* due to their friction with the wire 4. The wire 4 therefore fills up the space between the tubes 14*a* and 14*b* and shoe member 17*a* while being progressively compressed. At this instance, the axial lugs 14*a'* on the inner tube 14*a* serve to prevent the wire 4 from slipping in the circumferential direction on the inner tube 14*a*. Subsequently, the wire 4 is additionally compressed by the leading faces $27_2$ of the teeth on the rotary head 27' which is rotating in the opposite direction to the tubes 14*a* and 14*b*. As a result, the wire 4 turns into a half-fused or substantially half-fused state. The dies 26 individually cut continuous pre-processed wires from the material in such a state and feed them out as wires 8 through the associated passageway 28 in the die head 27'. It will be seen that each wire 8 can have any desired diameter which is determined by the diameter of each die 26. In this way, the large diameter wire 4 payed out from the carrier 3 is extruded by the dies 26 to form small diameter wires 8 while being compressed to a pressure level high enough to generate considerable heat. Such procedure establishes continuity between the conventional drawing and annealing operations. The wires 8 have their tensions controlled to a predetermined constant level by the adjuster rollers 29 which are driven for revolution in unison with the inner tube 14***a*. In the meantime a core element (wire 2) is supplied through the axial bore 23 in the rotary head 27. The wires 8 are thus fed into the twister holder 9 together with the core wire 2 by way of the guide plate 30. Then the twister die on the holder 31 twists the wire 8 around the core wire 2 to prepare a concentric lay cable 10 of a single layer. The product 10 is successively wound on the take-up drum 13 shown in FIG. 1 via the counter 11 and capstan 12.

Figure 14:
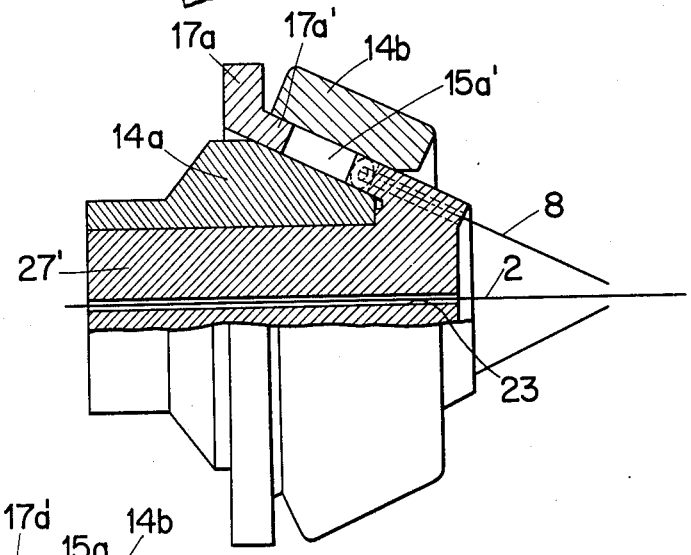
FIGS. 14–18 show other possible forms of the cutting and extrusion moulding machine.
Figure 15:
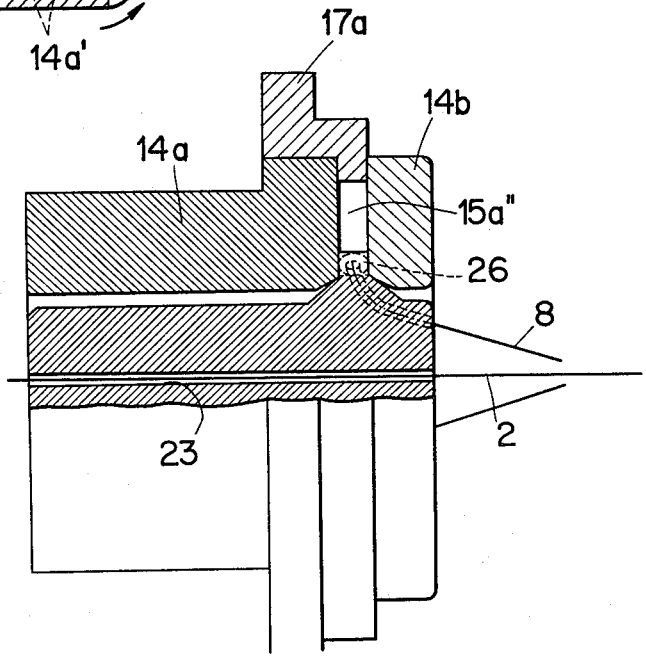

FIG. 14 shows an alternative extrusion machine in which the tubes 14*a* and 14*b* are so shaped and arranged as to define an annular space 15*a*′ which is inclined relative to the axis of the apparatus as illustrated. Another alternative machine is depicted in FIG. 15 which has an annular space 15*a*″ extending radially outwardly in perpendicular relation to the axis of the apparatus. In other words, the first and second tubular members are axially juxtaposed.

Figure 16:
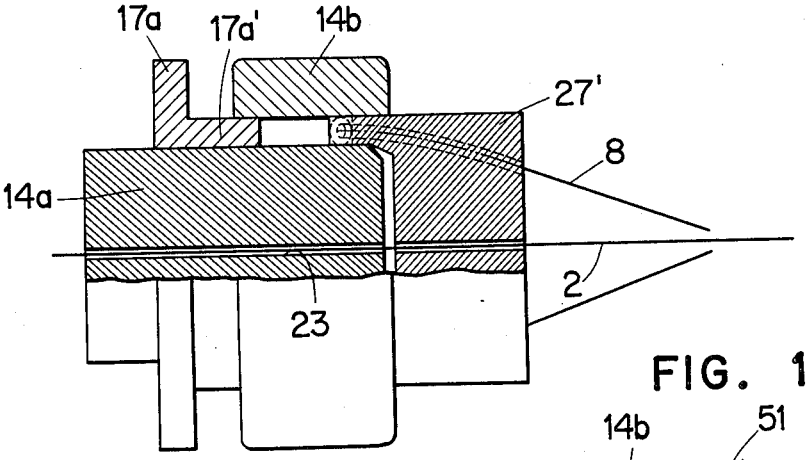

The rotary head 27 has been shown and described as being coupled in the inner tube 14*a* in the foregoing embodiments. Alternatively, the rotary head may be located to face the inner tube 14*a* from the twister side without being coupled therein, as indicated by the reference numeral 27′ in FIG. 16.

Figure 17:
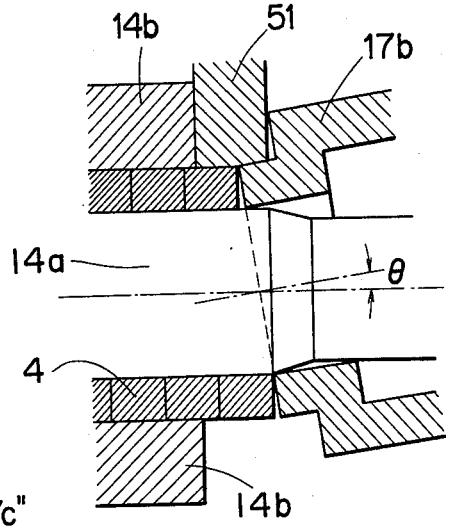
Figure 18:
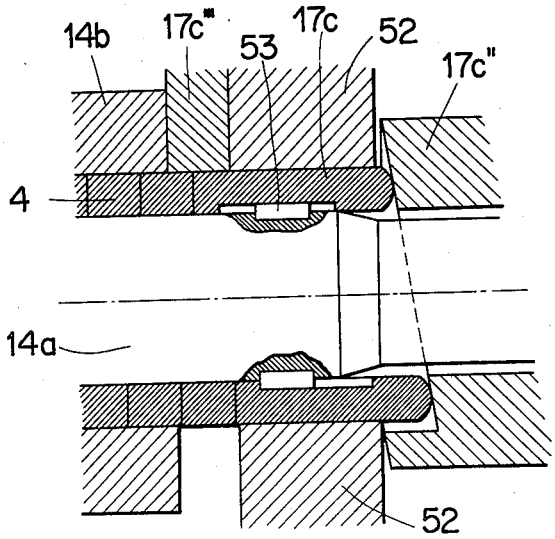

Referring to FIG. 17, the extrusion machine comprises a rotatable shoe member 17*b* which is mounted in a position inclined at an angle $\theta$ relative to the axis of the inner rotary element 14*a*. The shoe member 17*b* feeds the wire 4 successively into an annular space while rotating substantially in the same manner as the inner rotary element 14*a*. It will be seen here that the rotary shoe member 17*b* cannot feed the wire 4 but by an amount which is only about half a pitch (180° ) and, hence, it must be assisted by a stationary shoe member which feeds the wire by the other half pitch. The reference numeral 51 denotes a guide shoe. FIG. 18 shows a still another extrusion machine embodying the present invention. In FIG. 18, the machine comprises a rotatable and axially movable shoe member 17*c* for feeding out the wire 4. This shoe member 17*c* is divided into a plurality of equal parts which are individually mounted to the inner rotary element 14*a* by keys 53. With this construction, each of the shoe parts can rotate integrally with the inner rotary element 14*a* and move axially relative to the element 14*a* through a corresponding key 53. One end of each shoe part 17*c* is engaged by an inclined end of a stationary shoe member 17*c*. When the disc 14*a* is driven for rotation, the shoe member 17 will feed the material 4 pitch by pitch into the annular space rotating integrally with the disc 14*a* and moving axially in contact with the inclined end of the stationary shoe member 17*c*″. The movable shoe member 52 is surrounded by a shoe holder. The reference numeral 17*c*‴ denotes a stationary guide shoe member.

Figure 19:
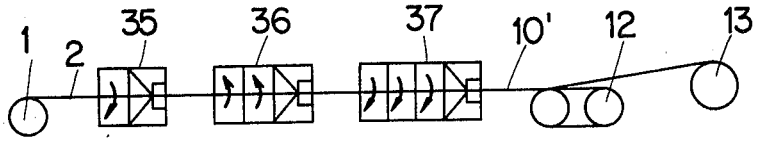
FIG. 19 is a schematic view of a multi-layer concentric stranded cable production system.

Referring to FIG. 19, a system for producing multilayer concentric cables is illustrated in a schematic diagram. The system comprises first to third cutting and extrusion moulding units 35, 36 and 37. Each of the units 35–37 is constituted by the cutting and moulding machine 7 and twister holder 9 depicted in FIGS. 1, 11, and 12. A core wire 2 is supplied from the carrier 1 to the first unit 35 which twists wires 8 around the core 2 to form a first layer. The second unit 36 twists other wires 8 around the first layer to form a second layer. The third unit 37 twists still other wires 8 around the second layer to form an outermost layer. The multilayer concentric cable 10′ is wound on the take-up drum 13 through the capstan 12 as has been discussed with reference to FIG. 1. In this way, a serial operative connection of a plurality of units can produce a concentric cable having a desired number of layers around a core wire. The intermediate unit 36 has two basic units 35 and the outlet unit 37 three basic units 35.

Figure 20:
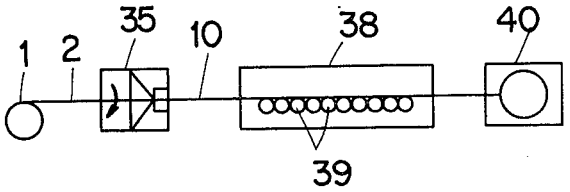
FIG. 20 is a schematic view of a hard drawn SB stranded cable production system.

Another system is shown in FIG. 20 which is designed to produce a hard drawn SB cable. A concentric cable 10 coming out of the basic unit 35 has its diameter reduced by a continuous drawing machine 38 which is equipped with a plurality of stretcher rollers 39 or dies. The cable 10 is then processed by a known puncher type twisting machine 40 to have a necessary twist pitch. Though not shown in the drawing, a finish die is positioned in the system to provide the cable from the machine 40 with a uniform diameter.

Figure 21:
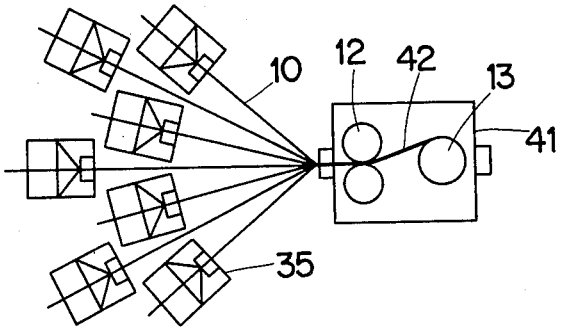
FIG. 21 is a schematic view of a composite stranded cable production system.

Another system is shown in FIG. 21 which is constructed to produce a composite cable. This system comprises a plurality of basic units 35 and a single twisting machine of a take-up rotary type 41. The basic units 35 are positioned radially with respect to the twisting machine 41. The machine 41 has a capstan 12 and a take-up drum 13 thereinside. The individual basic units 35 produce concentric cables 10 which are then fed to the twisting machine 41. The machine 41 driven for rotation processes the input concentric cables 10 into a composite cable 42. In the previously described manner, the product 42 is wound on the take-up drum 13 via the capstan 12.

Figure 22:
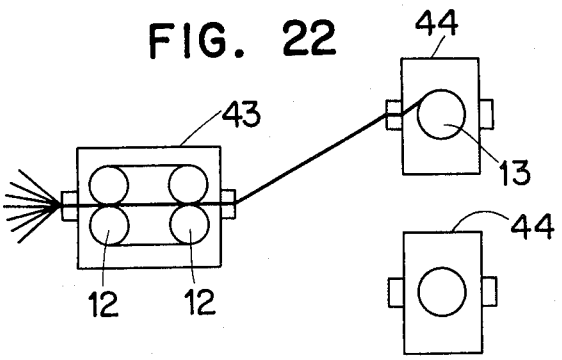
FIG. 22 is a schematic view of a modification to the system of FIG. 21.

A modified form of the system shown in FIG. 21 is illustrated in FIG. 22. The system of FIG. 22 is essentially similar to that of FIG. 21 except for a separate arrangement of the capstan 12 and take-up drum 13. Specifically, the system of FIG. 22 comprises a combination of a rotary twisting machine 43 with capstans 12 and a pair of take-up machines 44. These machines 43 and 44 are operatively connected together by a synchronous rotation mechanism (not shown). The modified system of FIG. 22 is advantageous over the system of FIG. 21 in that it can be operated continuously and need only be entirely stopped when the take-up machines 44 are changed from one to the other.

The present invention has been described concentrating on the production of concentric lay cables except for FIGS. 21 and 22. It will be apparent to those skilled in this art that multiple wires prepared by the cutting and moulding machine 7 or the basic unit 35, for example, can readily be twisted to form an aggregate cable and are applicable to the production of various kinds of compressed cables.

It will be seen from the foregoing that the present invention provides a method which not only establishes an uninterrupted continuous flow throughout drawing, annealing and twisting steps but permits a desired cable to be produced despite any change in the size through a simple replacement of a part of the component elements, i.e. dies or a rotary head.

What is claimed is:

1. A method of producing a stranded cable, comprising the steps of:

extruding axially a plurality of wires from a plurality of dies mounted to a rotary element rotatable in a predetermined direction; and twisting continuously said plurality of wires together to produce a stranded cable.

2. A method according to claim 1, wherein said twisting step includes a step of rotating said rotary element and holding the extruded wires at one point.

3. A method according to claim 2, further including the step of feeding out continuously another wire or another stranded cable from an axial bore of said rotary element concurrently with said plurality of wires to be subjected to said twisting step.

4. A method according to claim 3, wherein said twisting step includes the step of twisting said plurality of wires about said another wire or another stranded cable to produce a stranded cable.

5. A method according to claim 1, wherein said dies are radially arranged in a plane perpendicular to an axis of the rotary element.

6. A method according to claim 5, wherein each die is disposed at an equal distance from the axis of the rotary element.

7. A method according to claim 5, wherein said dies are spaced from each other by equal angular spacings.

8. A method according to claim 1, wherein said dies are removably mounted to the rotary member.

9. A method according to claim 8, wherein said dies are adapted to face the rotation of the rotary member.

10. A method according to claim 9, wherein said dies are adapted to preceed in a direction opposite the rotation of the rotary member.

11. A method of producing a stranded cable comprising the steps of:

extruding axially a plurality of wires from a plurality of dies respectively mounted to a plurality of rotary elements arranged in series;

twisting together said plurality of wires from the respective rotary elements to produce a plurality of stranded cables; and subjecting the stranded cable produced by each rotary element to a further twisting operation in which wires fed out by a succeeding rotary element are twisted about the stranded cable produced by dies on said each rotary element.

12. A method of producing a stranded cable comprising the steps of:

extruding axially a plurality of wires from a plurality of dies respectively mounted to a plurality of rotary elements arranged radially;

twisting said plurality of wires from the respective rotary elements to produce a plurality of stranded cables; and subjecting said plurality of stranded cables to a further twisting step to produce a stranded cable.

13. An apparatus for producing a stranded cable including at least one stranded cable producing unit, said unit comprising:

support means;

rotary means supported by said support means and rotatable in a predetermined direction, said rotary means defining an annular space;

a shoe member having a wire supply passageway bored therethrough to supply a roughened wire from outside the shoe member and facing said annular space to define an annular passageway in cooperation with said rotary means such that communication is provided between said wire supply passageway and said annular passageway to guide the roughened wire thereinto, said annular passageway being shaped to progressively compress the roughened wire;

a plurality of die assemblies arranged about the axis of rotation of said rotary means and each extending axially and facing said annular space, whereby the compressed wire is extruded into a plurality of wires; and means arranged downstream of said die assemblies for twisting said plurality of wires together into a cable.

14. An apparatus according to claim 13, wherein said annular passageway has a sectional area decreasing progressively in said predetermined direction from a point where the wire supply passageway meets the annular passageway at a predetermined rate to compress the roughened wire.

15. An apparatus according to claim 13, wherein said rotary means includes a rotary element having an annular groove therein to define said annular space, said annular groove having a continuous pocket therein.

16. An apparatus according to claim 13, wherein each die assembly includes a die holder threaded into the rotary member and having an axial passageway bored therethrough; and a die supported by said die holder to face the pocket for providing communication between said annular passageway and said axial passageway.

17. An apparatus according to claim 13, further including a guide roller provided in the shoe member and facing the annular passageway.

18. An apparatus according to any one of claims 15 to 17, wherein the rotary element has said annular groove in an outer periphery thereof.

19. An apparatus according to any one of claims 15 to 17, wherein said rotary member has an axial bore to guide another wire such that said another wire is subjected to a twisting operation together with said plurality of wires.

20. An apparatus according to claims 15 or 16, wherein said rotary element has said annular groove in an inner periphery thereof.

21. An apparatus according to any one of claims 15 to 17, wherein the rotary element has said annular groove axially therein.

22. An apparatus according to claim 21, wherein said rotary element is of a truncated conical shape.

23. An apparatus according to claim 13, wherein said rotary means includes a first tubular member and a second tubular member coaxially provided in association with said first tubular member to define said annular space therebetween; said shoe member has a shouldered end facing said annular space to guide a roughened wire from a shoulder portion thereof into said annular space; and said die assembly includes a shank engaging the second annular member, an annular die head having a saw-toothed end positioned in facing relation to said annular space and a flat end on an opposite side of the annular die head, said head being provided with a plurality of passageways bored therethrough, and a plurality of dies provided in inner openings of said passageways.

24. An apparatus according to claim 23, wherein said first tubular member is positioned to coaxially surround said second tubular member.

25. An apparatus according to claim 23, wherein said first and second tubular member are axially juxtaposed.

26. An apparatus according to claim 24, wherein said first and second members are generally of a truncated conical shape.

27. An apparatus according to claim 23, wherein said shank is inserted into the second annular member.

28. An apparatus according to claim 13, wherein said shoe member includes a stationary member.

29. An apparatus according to claim 23, wherein said shoe member includes a stationary member.

30. An apparatus according to claim 23, wherein said shoe member includes a rotary member or a moving member.

31. An apparatus according to claim 13, wherein said twisting means includes a twister holder disposed downstream of said plurality of die assemblies to hold said extrusion moulded plurality of wires at one point.

32. An apparatus according to claim 31, further including tension adjusting means provided between the die assemblies and the twister holder.

33. An apparatus according to claim 32, wherein said tension adjusting means includes at least one set of rollers arranged radially in association with the axis of the rotary means.

34. An apparatus according to claim 33, further including a wire guide plate disposed between said rollers and said twister holder.

35. An apparatus for producing a stranded cable including a plurality of stranded cable producing units, each unit comprising:

support means;

rotary means supported by said support means and rotatable in a predetermined direction, said rotary means defining an annular space;

a shoe member having a wire supply passageway bored therethrough to supply a roughened wire from outside the shoe member and facing said annular space to define an annular passageway in cooperation with said rotary means such that communication is provided between said wire supply passageway and said annular passageway to guide the roughened wire thereto, said annular passageway being shaped to progressively compress the roughened wire;

a plurality of die assemblies respectively arranged about the axis of rotation of said rotary means and each extending substantially axially and facing said annular space, whereby the compressed wire is extruded into a plurality of wires; and means arranged downstream of said units for twisting said plurality of wires from said die assemblies together into a cable.

36. An apparatus according to claim 35, wherein said plurality of stranded cable producing units are serially connected to produce a multi-layer concentric stranded cable.

37. An apparatus according to claim 35, wherein said plurality of stranded cable producing units are radially arranged to produce a multi-layer composite stranded cable.

* * * * *